US005990410A

United States Patent [19]

Johnson

[11] Patent Number: 5,990,410

[45] Date of Patent: Nov. 23, 1999

[54] ELECTRICAL MUSICAL INSTRUMENT

[75] Inventor: Kenneth G. Johnson, Shetland, United Kingdom

[73] Assignee: Skyinblow Limited, Shetland Isles, United Kingdom

[21] Appl. No.: 08/979,267

[22] Filed: Nov. 26, 1997

[30] Foreign Application Priority Data

Nov. 26, 1996 [GB] United Kingdom ..... 9624503

[51] Int. Cl.[6] ..... G10D 3/00

[52] U.S. Cl. ..... 84/731; 84/743; 84/275; 84/290; 84/291

[58] Field of Search ..... 84/730–731, DIG. 24, 84/743, 274, 275, 290, 291, 307, 309

[56] References Cited

U.S. PATENT DOCUMENTS

| | | | |
|---|---|---|---|
| 4,411,186 | 10/1983 | Faivre | 84/291 |
| 4,836,076 | 6/1989 | Bernier | 84/275 |
| 5,396,822 | 3/1995 | Itokawa | 84/291 |

*Primary Examiner*—William M. Shoop, Jr.
*Assistant Examiner*—Marlon T. Fletcher
*Attorney, Agent, or Firm*—Madson & Metcalf

[57] ABSTRACT

An electrical musical instrument in the form of an electric violin 1 comprises an instrument body 2 comprising a body member 6 comprising an upper convex member 7 and a lower convex member 8 attached to each other by means of screws at the upper and lower ends thereof. An aperture 4 is defined in the upper convex member 7 and is adapted to receive a bridge 5. A reinforcing member 11 extends along the length of the rear of the violin body 2. The violin 1 further comprises a wooden neck 3 extending from the body 2.

Electric pick-up means 10 supported by the instrument body 2 and provide an electrical output signal representing vibration of at least one tensioned string extending in use substantially along the length of the instrument 1 and passing over the bridge 5. The reinforcing member 11 in use opposes torque applied to the instrument body 2 and neck member 3 as a result of the tension in the or each string.

20 Claims, 5 Drawing Sheets

ELECTRICAL MUSICAL INSTRUMENT

The present invention relates to electrically operated musical instruments, and relates particularly, but not exclusively, to electric violins.

The traditional construction of acoustic violins is well known. Briefly, acoustic violins are constructed such that the vibration of highly tensioned strings by means of a violin bow produces sound within a hollow cavity formed by the body of the violin. In order to withstand the torque placed on the violin neck and body as a result of the tension in the strings passing over the bridge of the violin, the body of the violin must be of fairly robust construction. The necessity of the violin body serving the dual purpose of sound production and reinforcement against the torque produced by the strings results in such violins being very labour intensive to produce. This in turn makes such violins expensive.

Electric violins are becoming increasingly widespread, primarily because the volume of sound produced by such violins is easier to control than in the case of acoustic violins. Electric violins include an electrical pick-up device, which is usually electromagnetic or electromechanical in operation, and which provides an electrical output signal in response to vibration of the strings. The electrical output signal produced by the violin can be easily amplified or otherwise processed before being input to a loudspeaker.

Although it is generally unnecessary for the body of an electric violin to serve as a sound producing cavity, in order to withstand the torque to which the violin body and neck are subjected as a result of the tension in the strings, the violin body must still be of robust construction. As a result, the body is often constructed in the form of a hollow cavity similar to that of acoustic violins. This results in the violin still being labour intensive and expensive to produce, as well as having considerable weight if the violin is intended to include electrical apparatus such as amplifiers and power supplies.

Preferred embodiments of the present invention seek to overcome the above disadvantages of the prior art.

According to the present invention, there is provided an electrical musical instrument, the instrument comprising:

an instrument body comprising a body member for supporting a bridge on a first side thereof and a reinforcing member attached to a second side thereof;

a neck member attached to the instrument body and extending therefrom; and electrical pick-up means supported by the instrument body for providing an electrical output signal representing vibration of at least one tensioned string extending in use substantially along the length of the instrument and passing over the bridge;

wherein the reinforcing member in use opposes torque applied to the instrument body and neck member as a result of the tension in the or each string.

By providing an electrical pick-up means and a reinforcing member, it is not necessary to construct the instrument body in the form of hollow chamber. This provides the advantage of enabling an instrument having the necessary mechanical strength to be constructed more lightly and inexpensively than in the case of the prior art. The instrument of the present invention can also be constructed using less skilled labour than in the case of the prior art, for example using computer aided manufacturing of at least some of the components.

In a preferred embodiment, the reinforcing member is attached to the body member adjacent first and second ends thereof and extends substantially parallel to the neck member.

Preferably, the reinforcing member has a concave portion adjacent the neck member.

The reinforcing member may have a transverse portion arranged opposite the bridge of the instrument in use and abutting against said body member.

This provides the advantage of enabling the forces exerted on the body member as a result of the or each string passing over the bridge to be simply and effectively counteracted.

In a preferred embodiment, the reinforcing member further comprises a convex portion arranged adjacent said transverse portion.

The instrument preferably further comprises load spreading means arranged adjacent the attachment of the neck member to the instrument body.

The load spreading means may comprise a load spreading member arranged between the body member and the neck member.

Alternatively, or in addition, the load spreading means may comprise an elongated attachment portion of the reinforcing member.

In a preferred embodiment, the body member further comprise first and second convex members attached together to define a hollow chamber therein and said first convex member includes an aperture for receiving the bridge.

Preferably, the pick-up means is arranged in use between the bridge and the second convex member.

The instrument may further comprise an output housing attached to the instrument body and connected to the electrical pick-up means for providing an electrical output signal to an amplifier and/or loud speaker.

The output housing may further comprise a source of electrical power.

Alternatively, or in addition, the output housing may include volume control means.

In a preferred embodiment, the electrical pick-up means includes a piezoelectric transducer.

The pick-up means may further comprise a treble resonance filter.

The pick-up means preferably further comprises an electrical interface for preamplification and/or electrical impedance matching.

The instrument is preferably a violin.

As an aid to understanding the invention, a preferred embodiment thereof will now be described in detail by way of example only, and not in any limitative sense, with reference to the accompanying drawings, in which.

Figure 1:
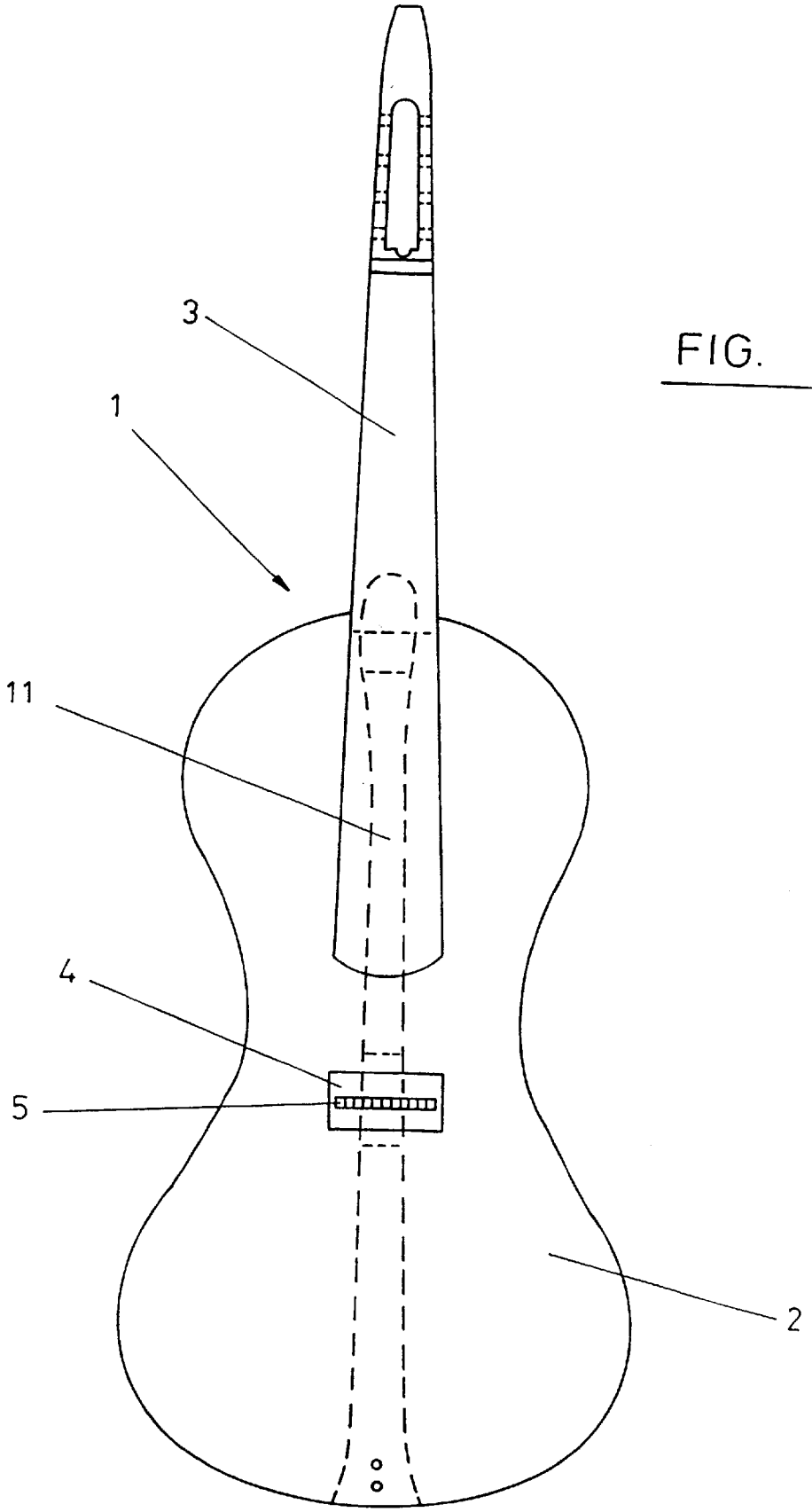
FIG. 1 is a schematic plan view of an electric violin embodying the present invention and without strings attached.
Figure 5A:
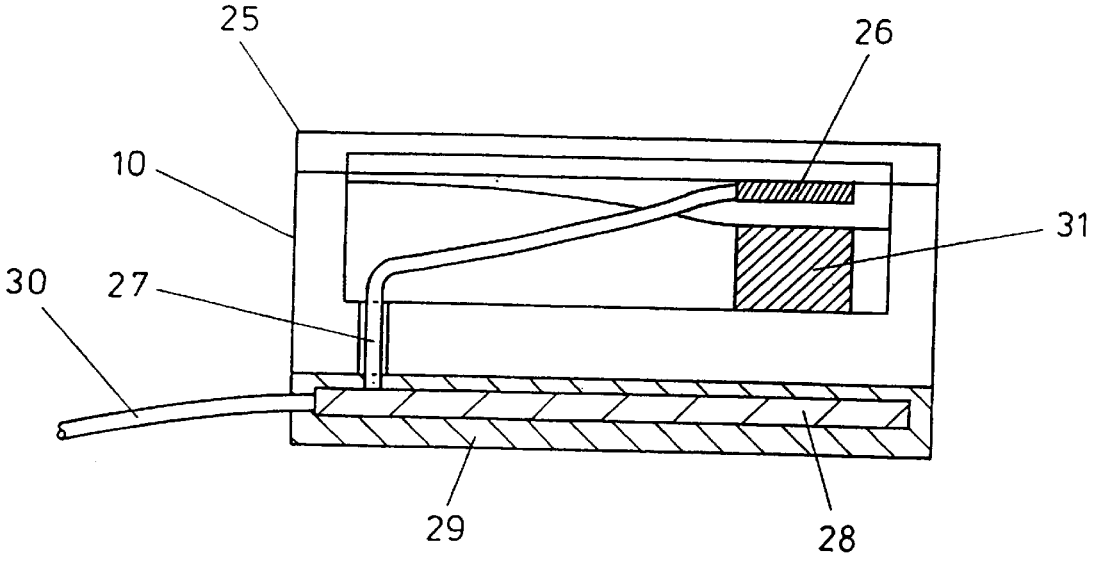
Figure 5B:
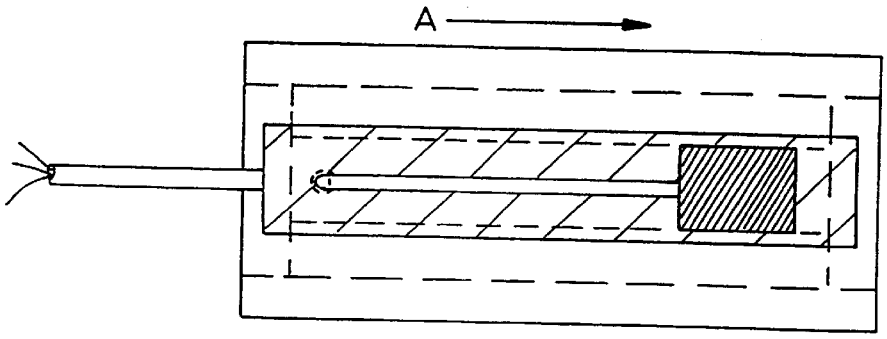
Figure 5C:
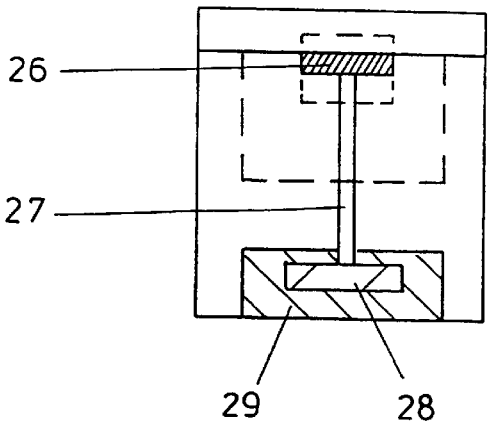

FIG. 5*a* is a cross-section elevational view of an electrical pick-up of the violin of FIG. 1;

FIG. 5*b* is a schematic plan view of the electrical pick-up of FIG. 5*a*; and FIG. 5*c* is a cross-section end view of the pick-up of FIGS. 5*a* and 5*b* in the direction of arrow A in FIG. 5*b*.

Referring in detail to FIG. 1, an electric violin 1 comprises a violin body 2 of wood and to which a wooden neck 3 is attached for supporting tensioned strings (not shown) which extend substantially along the entire length of the violin 1. The wooden components of the violin 1 may be produced by means of computer aided carving apparatus such as CNC devices as will be known to persons skilled in the art. An aperture 4 is provided in the body 2 for receiving a bridge 5, which may be a conventional violin bridge, over which the tensioned strings pass in a manner which will be well known to persons skilled in the art.

Figure 2:
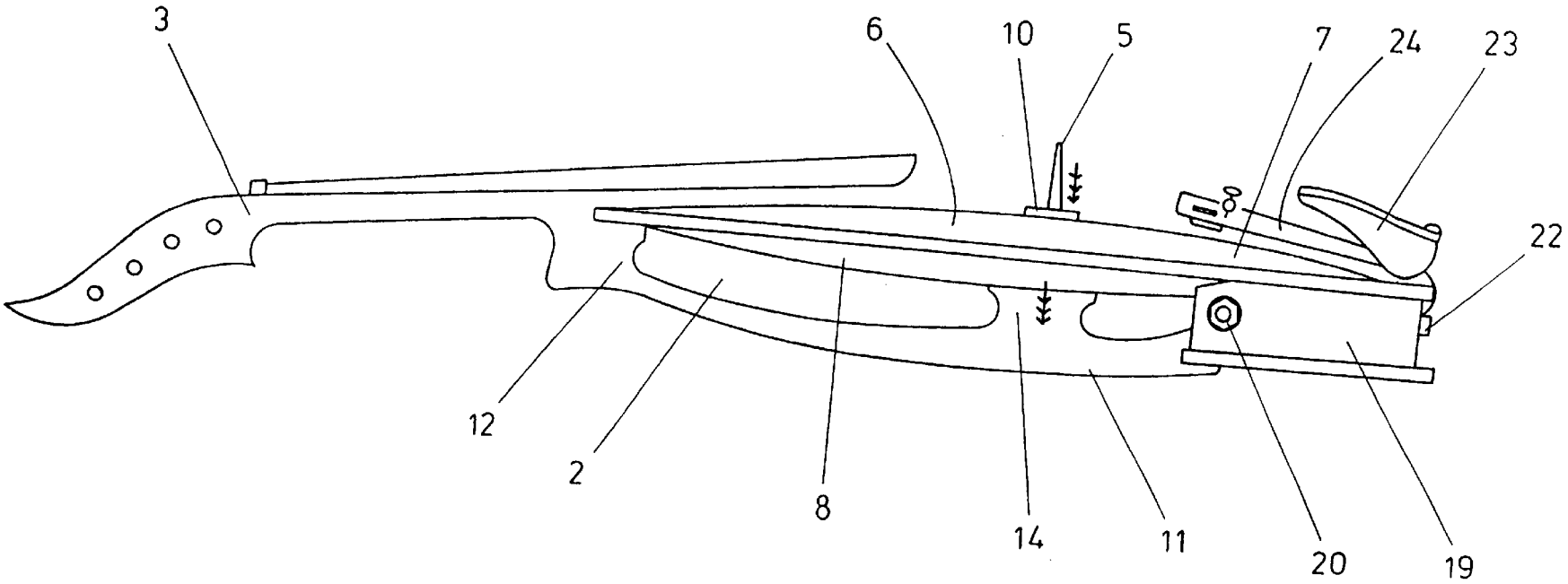
FIG. 2 is a lengthwise side view of the electric violin of FIG. 1.
Figure 3:
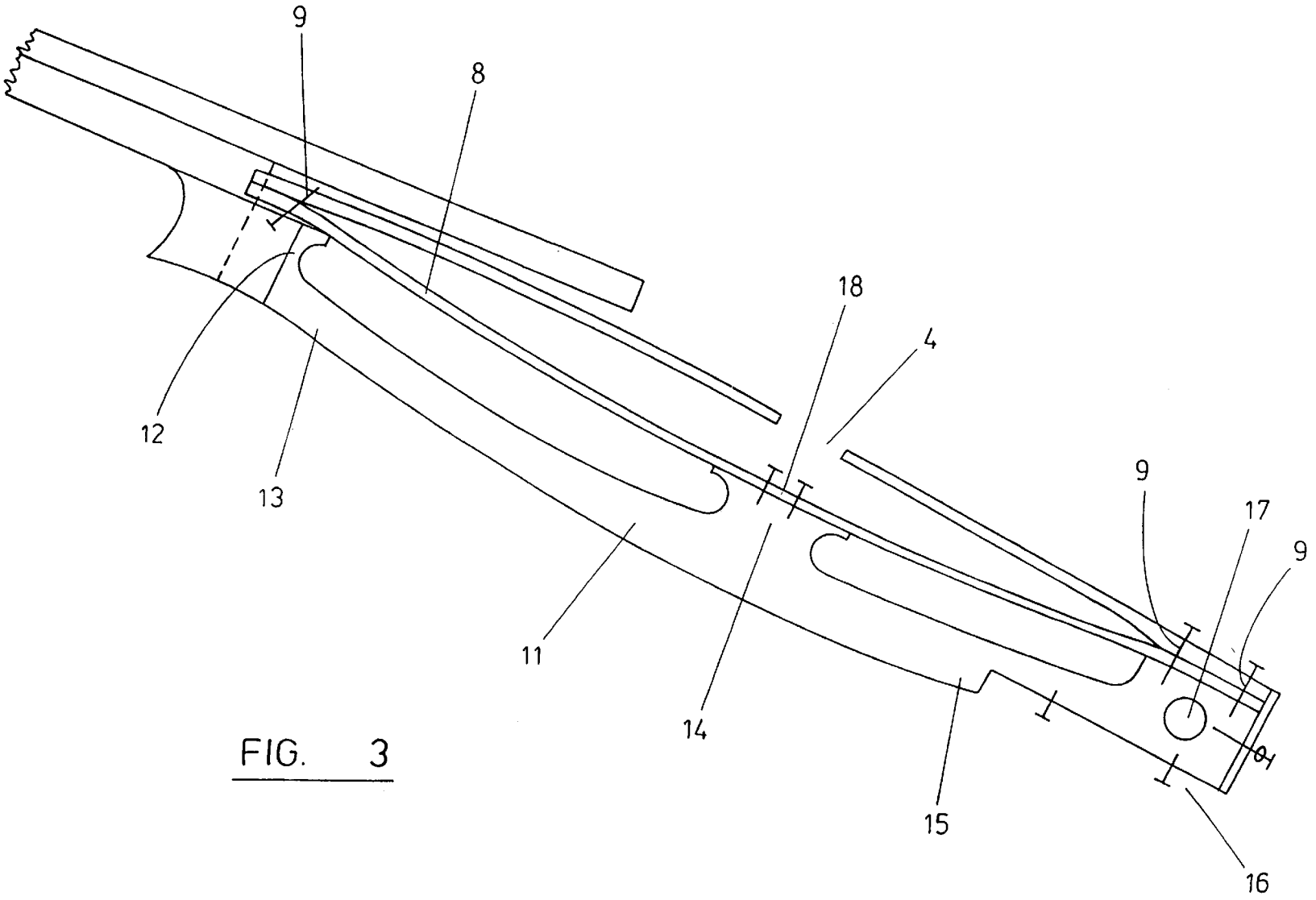
FIG. 3 is an enlarged cross-section, corresponding to FIG. 2, but with the bridge and output housing removed.

Referring to FIG. 2, the violin body 2 includes a body member 6 formed from an upper convex member 7 and a lower convex member 8 which are attached to each other by means of screws 9 (see FIG. 3) at the upper and lower ends thereof. Aperture 4 is defined in the upper convex member 7, and receives a piezoelectric pick-up device 10 in the form of an active acoustic modular pick-up. The pick-up device 10 is located between the rear internal surface of lower convex member 8 and the bridge 5 such that the pick-up device 10 protrudes slightly out of aperture 4.

A reinforcing member 11 (shown by dotted lines in FIG. 1) extends along the length of the rear of the violin body 2 and comprises an elongated attachment portion 12 for attachment to the body member 6. A concave portion 13 is provided adjacent to the elongate attachment 12, and a transverse strut 14 abuts against the rear of the lower convex member plate 8 to oppose downward forces exerted thereon as a result of the tension in the strings pushing the bridge 5 downwardly as shown in FIG. 2.

The reinforcing member 11 includes a convex portion 15 arranged adjacent the strut 14 and on both sides thereof, and has a recess 16 and an aperture 17. The strut 14 is attached to the lower convex member 8 by means of screws 18.

Figure 4:
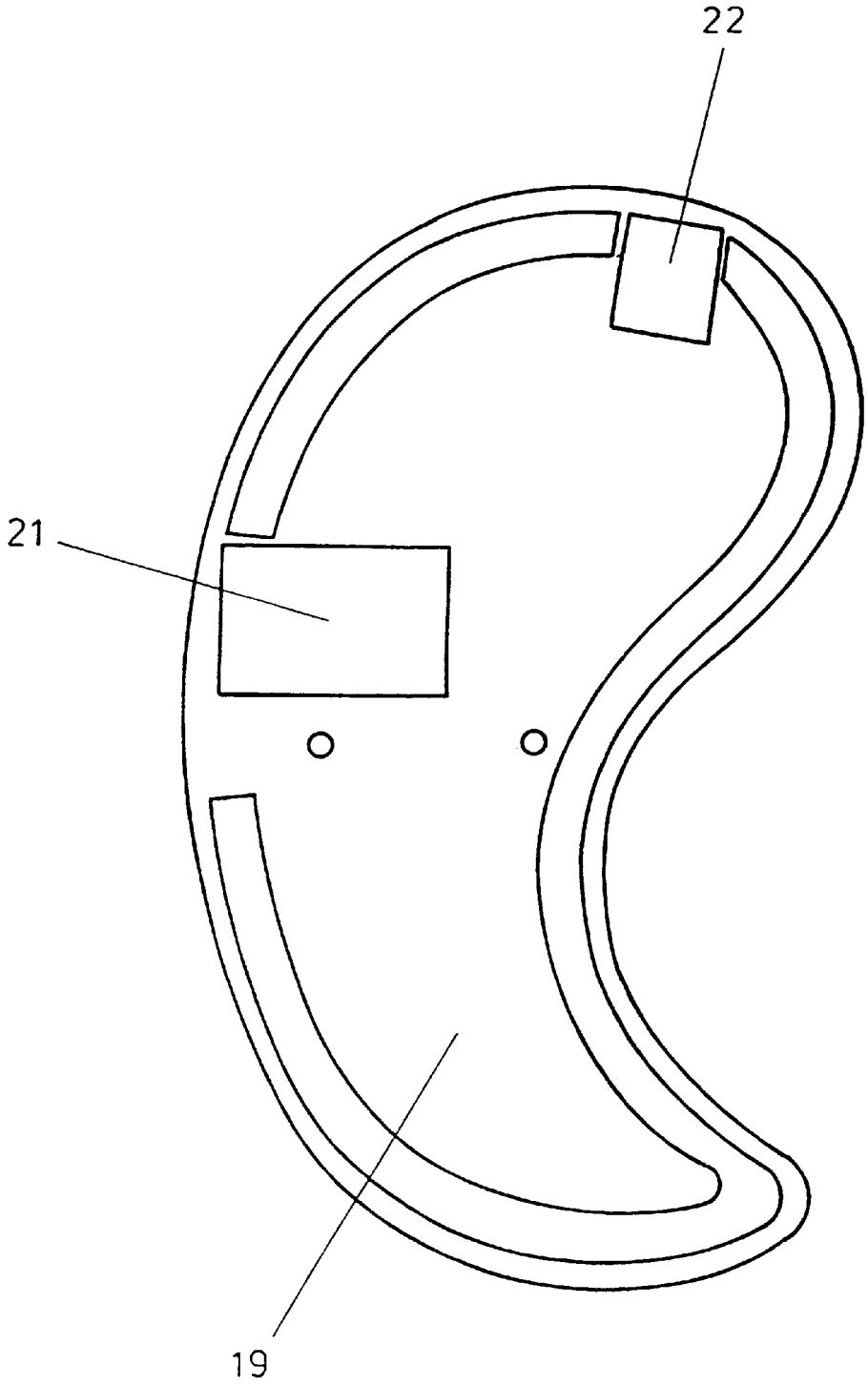
FIG. 4 is a schematic plan view of the output housing of FIG. 2.

An output housing 19 is attached adjacent the lower end of the violin body 2 by means of a bolt 20 passing through aperture 17. As shown in greater detail in FIG. 4, the output housing 20 includes a battery 21 and a jack socket 22 for outputting an electrical signal to an amplifier or loud speaker (not shown). The output housing 19 also acts as a shoulder rest to give the violin 1 the feel of an acoustic violin, and is generally constructed from wood and high density foam rubber.

A conventional violin chin rest 23 (see FIG. 2) is provided on the upper surface of the violin body 2 opposite the output housing 19, and a string attachment 24 is located under the chin rest 23 for supporting ends of the tensioned strings.

Referring to FIGS. 5*a*, 5*b*, and 5*c* the pick-up device 10 is received in a recess (not shown) in the upper surface of lower convex member 8 and is constructed to have sufficient depth that a portion 25 thereof protrudes slightly from the aperture 4 in the upper convex member 7. The pick-up 10 comprises a piezoelectric element 26 for producing an electrical output signal along lead 27 in response to mechanical vibration transmitted from the strings to the element 26 via the bridge 5, and the other end of lead 27 is connected to an active electrical interface circuit 28 which carries out preamplification and impedance matching. The interface 28 is embedded in an epoxy insulator 29 and outputs an amplified electrical signal along lead 30 to jack socket 22. A treble resonance filter 31 of foam rubber is provided underneath the piezoelectric element 26 and serves to filter out treble frequencies which may otherwise produce harsh components in the output signal.

In operation of the device, when the strings are played by stroking with a conventional violin bow (now shown) vibration thereof is transmitted through the bridge 5 to the piezoelectric element 26 in the pick-up device 10. As a result, a preamplified electrical signal is output along lead 30 and can be output via jack socket 22 to a loud speaker. The volume of the output signal may be controlled by means of a volume control means (not shown) provided on the output housing 19.

It will be appreciated by persons skilled in the art that the above embodiment has been described by way of example only and not in any limitative sense, and that various alterations and modifications are possible without departure from the scope of the invention as defined by the appended claims.

I claim:

1. An electrical musical instrument, the instrument comprising:

an instrument body comprising first and second convex members attached together at upper and lower ends thereof to define a hollow chamber therein, the first convex member including an aperture;

a bridge at least partially disposed in the aperture;

a reinforcing member disposed adjacent to the second convex member of the instrument body and attached thereto at the upper and lower ends, wherein the reinforcing member comprises a transverse portion disposed opposite the bridge of the instrument and abutting against the second convex member;

a neck member attached to the instrument body and extending therefrom; and an electrical pickup means supported by the instrument body for providing an electrical output signal representing vibration of at least one tensioned string extending in use substantially along the length of the instrument and passing over the bridge;

wherein the reinforcing member in use opposes torque applied to the instrument body and neck member as a result of the tension in the at least one tensioned string.

2. An instrument according to claim 1, wherein the reinforcing member has a concave portion adjacent the neck member.

3. An instrument according to claim 1, wherein the reinforcing member further comprises a convex portion arranged adjacent said transverse portion.

4. An instrument according to claim 3, further comprising load spreading means arranged adjacent the attachment of the neck member to the instrument body.

5. An instrument according to claim 1, further comprising load spreading means arranged adjacent the attachment of the neck member to the instrument body.

6. An instrument according to claim 5, wherein the load spreading means comprises a load spreading member arranged between the body member and the neck member.

7. An instrument according to claim 5, wherein the load spreading means comprises an elongated attachment portion of the reinforcing member.

8. An instrument according to claim 7, wherein the pickup means is arranged in use between the bridge and the second convex member.

9. An instrument according to claim 1, further comprising an output housing attached to the instrument body and connected to the electrical pick-up means for providing an electrical output signal to an amplifier and/or loud speaker.

10. An instrument according to claim 9, wherein the output housing further comprises a source of electrical power.

11. An instrument according to claim 10, wherein the output housing includes volume control means.

12. An instrument according to claim 1, wherein the electrical pick-up means includes a piezoelectric transducer.

13. An instrument according to claim 12, wherein the pick-up means further comprises a treble resonance filter.

14. An instrument according to claim 12, wherein the pick-up means further comprises an electrical interface for preamplification and/or electrical impedance matching.

15. An instrument according to claim 1, wherein the instrument is a violin.

16. An instrument according to claim 1, wherein the reinforcing member extends substantially parallel to the neck member.

17. An electrical musical instrument, comprising:

a body comprising first and second convex members attached together at upper and lower ends thereof to define a hollow chamber therein, the first convex member including an aperture;

a bridge at least partially disposed in the aperture;

a neck member attached to the body and extending therefrom;

a reinforcing member disposed adjacent to the exterior of the body and extending along the length of the body, wherein the reinforcing member is attached to the upper and lower ends of the second convex member of the body and the reinforcing member abuts against the second convex member at a location opposite the bridge, and wherein the reinforcing member opposes torque applied to the body and the neck member as a result of the tension in at least one tensioned string; and an electrical pickup supported by the body for providing an electrical output signal representing vibration of the at least one tensioned string extending in use substantially along the length of the instrument and passing over the bridge.

18. An instrument according to claim 17, wherein the reinforcing member has a concave portion adjacent the neck member.

19. An instrument according to claim 17, wherein the electrical pick up is disposed between the bridge and the second convex member.

20. An instrument according to claim 17, wherein the reinforcing member is not in contact with the body along the entire length of the body.

* * * * *